US012595536B1

(12) United States Patent
Korenstein

(10) Patent No.: US 12,595,536 B1
(45) Date of Patent: Apr. 7, 2026

(54) NANOCOMPOSITES INCLUDING GALLIUM ARSENIDE AND SILICON

(71) Applicant: Raytheon Company, Arlington, VA (US)

(72) Inventor: Ralph Korenstein, Natick, MA (US)

(73) Assignee: Raytheon Company, Arlington, VA (US)

( * ) Notice: Subject to any disclaimer, the term of this patent is extended or adjusted under 35 U.S.C. 154(b) by 1078 days.

(21) Appl. No.: 17/537,845

(22) Filed: Nov. 30, 2021

Related U.S. Application Data

(63) Continuation-in-part of application No. 17/523,990, filed on Nov. 11, 2021.

(60) Provisional application No. 63/112,407, filed on Nov. 11, 2020.

(51) Int. Cl.
*C22C 28/00* (2006.01)
*C22C 1/059* (2023.01)

(52) U.S. Cl.
CPC ..... *C22C 28/00* (2013.01); *C22C 1/059* (2023.01)

(58) Field of Classification Search
CPC ..... C22C 28/00; C01G 17/00; C01G 28/00; C01G 15/00; C01G 15/003; C01G 15/006; C01B 33/00; C01B 33/02
USPC ..... 75/230; 420/555, 678
See application file for complete search history.

(56) References Cited

U.S. PATENT DOCUMENTS 3,448,184 A 6/1969 Moss et al.
4,282,024 A 8/1981 Copley et al.
4,907,846 A * 3/1990 Tustison ..... G02B 1/115 359/359
4,939,043 A 7/1990 Biricik et al.
5,818,631 A 10/1998 Askinazi et al.
6,700,699 B1 3/2004 Cook
9,709,699 B2 7/2017 Sunne et al.
2003/0203205 A1* 10/2003 Bi ..... B22F 1/054 428/402
2004/0174917 A1* 9/2004 Riman ..... C09K 11/7705 372/43.01
2008/0254362 A1* 10/2008 Raffaelle ..... B82Y 30/00 429/188
2013/0170044 A1* 7/2013 Mont ..... B82Y 20/00 977/700
2013/0280854 A1 10/2013 Jasieniak et al.
2015/0017432 A1 1/2015 Shoseyov et al.

OTHER PUBLICATIONS

T.M. Hartnett, S.D. Bernstein, E.A. Maguire, and R.W. Tustison, "Optical Properties of ALON (aluminum oxynitride)," Proc. SPIE, vol. 3060, Window and Dome Technologies and Materials V, Jun. 27, 1997, pp. 284-295. (Year: 1997).*

Markku Tilli and Atte Haapalinna, "Properties of silicon," Handbook of Silicon Based MEMS Materials and Technologies, Third Ed., Ch. 1, 2000, pp. 3-17. (Year: 2000).*

Mateck Gallium Arsenide, Ceramic Material Data Sheets, MatWeb, 2022. (Year: 2022).*

(Continued)

*Primary Examiner* — Vanessa T. Luk

(74) *Attorney, Agent, or Firm* — Schwegman Lundberg & Woessner, P.A.

(57) ABSTRACT

A nanocomposite including silicon (Si) and gallium arsenide (GaAs), infrared (IR) windows including the nanocomposite, methods of making the nanocomposite, and methods of using the nanocomposite.

19 Claims, 3 Drawing Sheets

(56) References Cited

OTHER PUBLICATIONS

"U.S. Appl. No. 17/523,990, Non Final Office Action mailed Dec. 22, 2022", 15 pgs.
"U.S. Appl. No. 17/523,990, Advisory Action mailed Sep. 8, 2023", 3 pgs.
"U.S. Appl. No. 17/523,990, Final Office Action mailed Jul. 7, 2023", 20 pgs.
"U.S. Appl. No. 17/523,990, Final Office Action mailed Oct. 21, 2025", 23 pgs.
"U.S. Appl. No. 17/523,990, Non Final Office Action mailed Apr. 7, 2025", 27 pgs.
"U.S. Appl. No. 17/523,990, Response filed Mar. 22, 2023 to Non Final Office Action mailed Dec. 22, 2022", 11 pgs.
"U.S. Appl. No. 17/523,990, Response filed Jul. 7, 2025 to Non Final Office Action mailed Apr. 7, 2025", 14 pgs.
"U.S. Appl. No. 17/523,990, Response filed Aug. 29, 2023 to Final Office Action mailed Jul. 7, 2023", 13 pgs.
Cobb, Harold M, "Dictionary of Metals", ASM International, (2012), pp. 17, 26, 136, 148.

* cited by examiner

NANOCOMPOSITES INCLUDING GALLIUM ARSENIDE AND SILICON

CROSS-REFERENCE TO RELATED APPLICATIONS

This application is a continuation-in-part of and claims the benefit of priority under 35 U.S.C. § 120 to U.S. Utility patent application Ser. No. 17/523,990, filed Nov. 11, 2021, which claims the benefit of priority under 35 U.S.C. § 119(e) to U.S. Provisional Patent Application Ser. No. 63/112,407, filed Nov. 11, 2020, the disclosures of which are incorporated herein in their entirety by reference.

BACKGROUND

Sulfide-based nanocomposites, such as nanocomposites including zinc sulfide (ZnS) and calcium lanthanum sulfide $CaLa_2S_4$ (CLS), suffer from susceptibility to moisture contamination and reaction with water, which results in formation of materials (i.e., impurities) that absorb certain wavelengths of infrared light, such as longwave-infrared light. A nanocomposite material is needed that is transparent to infrared light and that is not prone to impurities that absorb infrared light.

SUMMARY OF THE INVENTION

Various embodiments provide a nanocomposite that includes silicon (Si) and gallium arsenide (GaAs).

Various embodiments provide a nanocomposite that includes silicon (Si) that is at least about 99.99 wt % pure. The nanocomposite also includes gallium arsenide (GaAs) that forms a homogeneous mixture with the Si. The GaAs is at least about 99.99 wt % pure. The nanocomposite has a molar ratio of the Si to the GaAs of about 1:9 to about 9:1. The nanocomposite includes independent phases of the Si and the GaAs that are distinct from one another. The nanocomposite is substantially free of phases of the Si and phases of the GaAs that are combined or indistinct from one another. The independent phase of the Si and the independent phase of the GaAs independently have a largest dimension of 50 nm to 400 nm. The nanocomposite has a hardness that is greater than a hardness of the Si alone and that is greater than a hardness of the GaAs alone.

Various embodiments provide an infrared window including the nanocomposite that includes Si and GaAs.

Various embodiments provide a method of using the nanocomposite including Si and GaAs. The method includes transmitting and/or receiving infrared light through the nanocomposite.

Various embodiments provide a method of making the nanocomposite including Si and GaAs. The method includes sintering a green body including a compressed homogeneous mixture including Si particles and GaAs particles to form the nanocomposite.

In various embodiments, the nanocomposite and its starting material are not reactive with water to form impurities that absorb infrared light. In various embodiments, the nanocomposite can provide improved infrared light transmission over wavelengths that are difficult or impossible for other nanocomposites to achieve, such as sulfide-based nanocomposite.

BRIEF DESCRIPTION OF THE FIGURES

The drawings illustrate generally, by way of example, but not by way of limitation, various embodiments of the present disclosure.

DETAILED DESCRIPTION OF THE INVENTION

Figure 1:
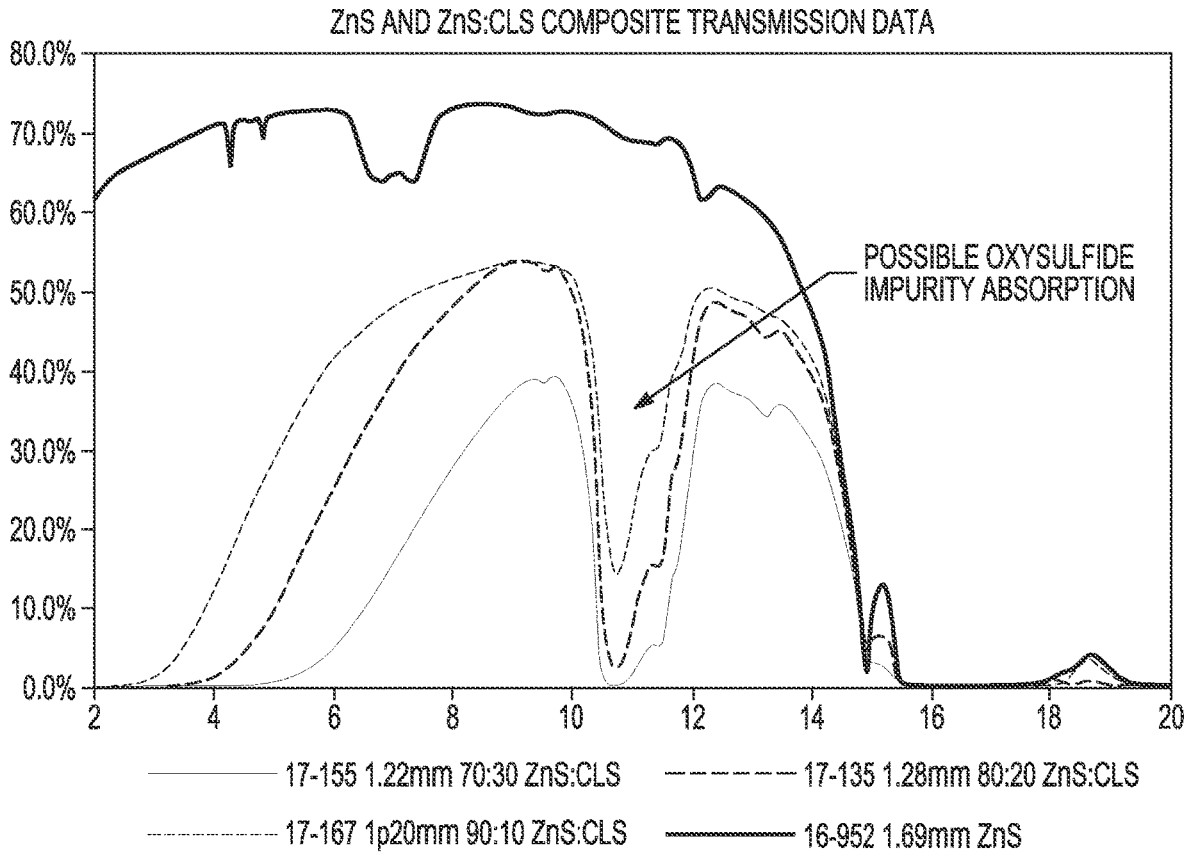
FIG. 1 illustrates ZnS and ZnS:CLS composite transmission data.

Reference will now be made in detail to certain embodiments of the disclosed subject matter. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the present disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that about 0 wt % to about 5 wt % of the composition is the material, or about 0 wt % to about 1 wt %, or about 0 wt %.

Nanocomposite.

Figure 2:
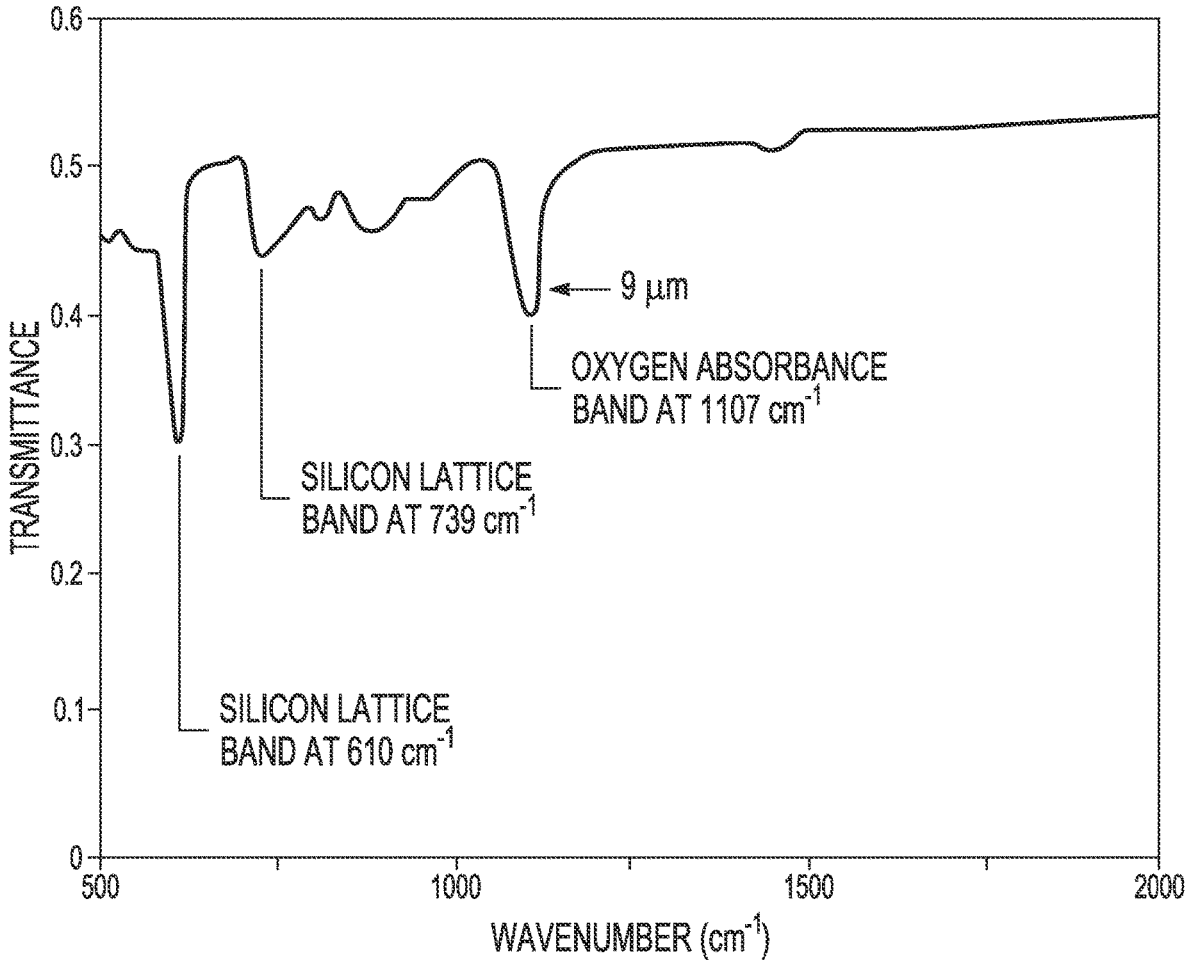
FIG. 2 and FIG. 3 illustrate the transmittance of GaAs and Si in accordance with some embodiments.
Figure 3:
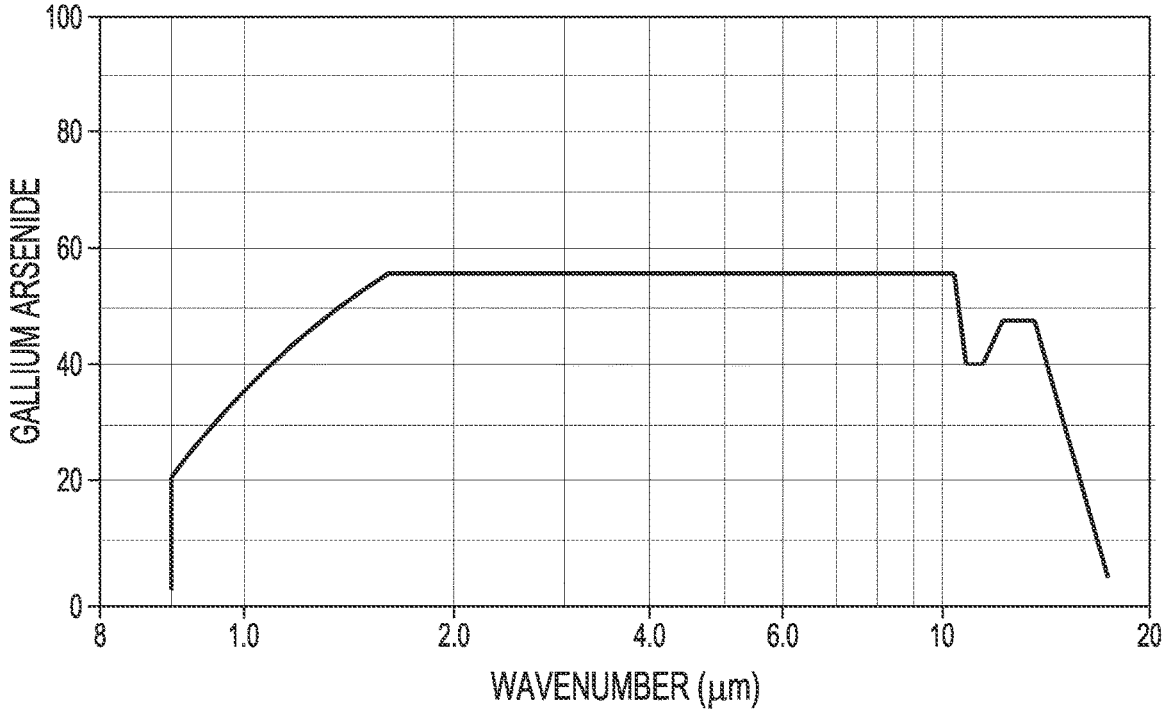

New sulfide-based nanocomposite materials which typically consist of two different metal sulfides such as zinc sulfide (ZnS) and calcium lanthanum sulfide $CaLa_2S_4$ (CLS) are susceptible to moisture (see FIG. 1). This manifest itself in the form of poor optical properties. For example, detrimental deep absorption bands are observed both in the midwave IR and longwave IR. These absorptions are attributed to the presence of sulfates, and oxysulfides which are formed by the reaction of moisture with the finely divided nano sulfide powders. On the other hand, it well known that GaAs and Si are not susceptible to moisture (see FIG. 2 and FIG. 3). Embodiments disclosed herein provide for making midwave- and longwave-IR nanocomposites from GaAs and Si.

Prior attempts to prevent powder contamination have not been successful. The sulfate and oxysulfide impurities can be removed from the ZnS-CLS nanocomposite powders by treating at elevated temperatures with hydrogen sulfide ($H_2S$) in a furnace. However, as soon as the powders are removed from the furnace, they again begin to react with the moisture in the atmosphere. In addition, further powder processing steps such as batching, milling and screening necessarily expose the cleaned powders to moisture. Nanocomposites based on GaAs and Si are not moisture sensitive.

Figure 4:
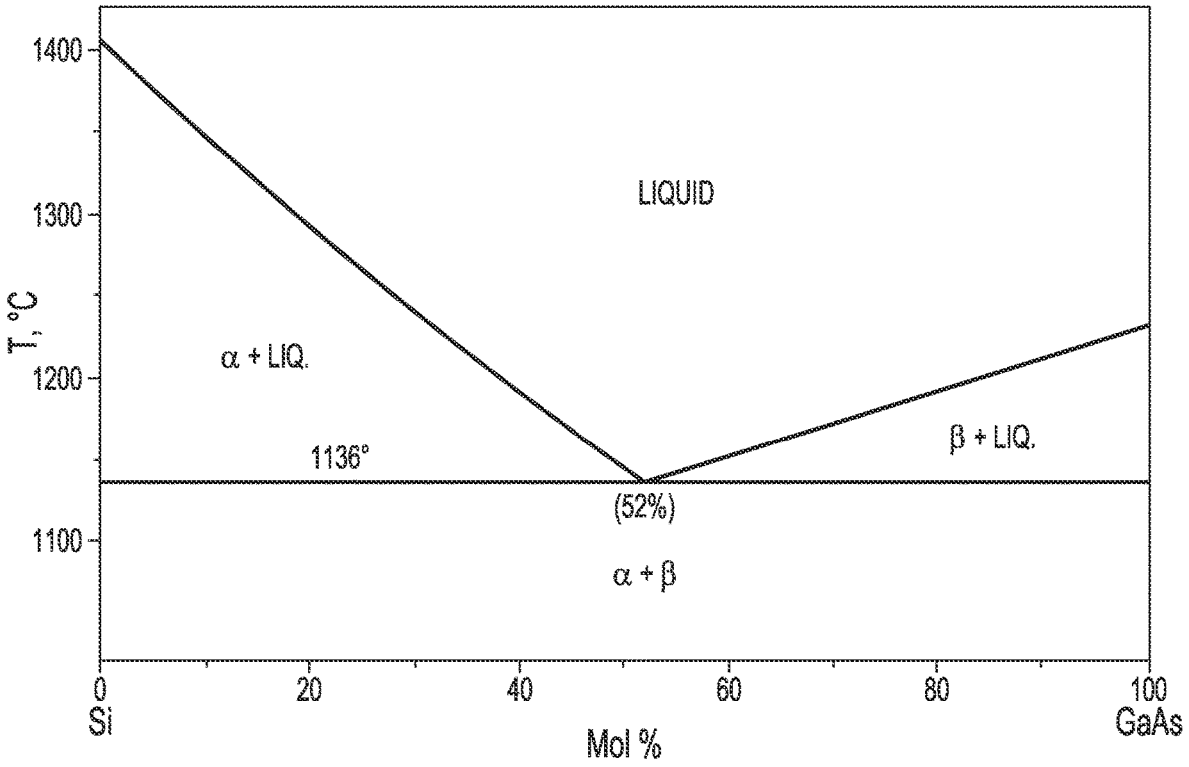
FIG. 4 illustrates a GaAs—Si Phase Diagram in accordance with some embodiments.

Some embodiments comprise nanocomposites comprising two different materials—GaAs and Si. To form a nanocomposite, the two materials should have little or no solubility in each other. The phase diagram (see FIG. 4) between GaAs and Si indicates two separate phases. GaAs and Si are in separate phases across the entire composition range with no solubility in each at temperatures below 1150° C. In addition, both GaAs and Si transmit into the longwave IR. Thus, it is possible to make midwave/longwave transparent nanocomposites of these materials.

This is the first time that nanocomposites of GaAs and Si are being proposed for midwave and longwave IR window applications. Unlike the sulfide nanocomposites, these materials are not susceptible to moisture. Unlike the sulfides, the synthesis of GaAs and Si nanocomposites is relatively straightforward. Simple high temperature sintering between nano powders of GaAs and Si results in the formation of nanocomposites.

The new class of nanocomposite materials based on metal sulfides such as ZnS—$CaLa_2S_4$ are susceptible to moisture and thus have proven difficult to produce without impurities that severely affect their optical properties.

GaAs—Si based nanocomposites can be an alternate material to those made from sulfides. Both GaAs and Si are not susceptible to moisture and both transmit well into the longwave IR. The phase diagram shown in FIG. 4 indicates that nanocomposite formation is possible. Embodiments disclosed herein include forming GaAs—Si nanocomposites from GaAs and Si nano powders.

GaAs—Si based nanocomposites offer an alternative material system for investigation that are not susceptible to moisture. Unlike the sulfide nanocomposites, these nanocomposites are not be susceptible to moisture. Unlike the sulfides, the synthesis of GaAs—Si nanocomposites is relatively straightforward by high temperature sintering. There is no need for complicated and expensive flame pyrolysis equipment that is required for the formation of sulfide base materials or for mixing of sulfide materials.

Various embodiments provide a nanocomposite including silicon (Si) and gallium arsenide (GaAs). The silicon is elemental silicon. The Si and GaAs together can be 80 wt % to 100 wt % of the nanocomposite, 95 wt % to 100 wt %, 99.9 wt % to 100 wt %, 99.999 wt % to 100 wt %, or less than or equal to 100 wt % and greater than or equal to 80 wt %, 81, 82, 83, 84, 85, 86, 87, 88, 89, 90, 91, 92, 93, 94, 95, 96, 97, 98, 99, 99.9, 99.99, 9.999, 99.9999, 99.99999, or 99.999999 wt %. The nanocomposite can have a molar ratio of the Si to the GaAs of about 5:95 to about 95:5, or about 1:9 to about 9:1, or about 1:4 to about 4:1, or less than or equal to 95:5 and greater than or equal to 5:95, 1:9, 2:9, 3:9, 4:9, 5:9, 6:9, 7:9, 8:9, or 1:1, 2:1, 3:1, 4:1, 5:1, 6:1, 7:1, 8:1, or 9:1. The Si and the GaAs are homogeneously distributed throughout the nanocomposite. The nanocomposite can be less than 1 wt % water, such as less than 0.1 wt % water, or less than 0.0001 wt % water. In various embodiments, the nanocomposite can have a hardness that is greater than the hardness of the Si, and that is greater than the hardness of the GaAs.

The nanocomposite includes independent phases of the Si and the GaAs that are distinct from one another. The nanocomposite can include a single Si phase and a single GaAs phase, and can be free of other Si phases or GaAs phases. The nanocomposite can be substantially free of phases of the Si and phases of the GaAs that are combined or indistinct from one another. The nanocomposite can be substantially free of Si-containing phases that include GaAs. The nanocomposite can be substantially free of GaAs-containing phases that include Si.

The nanocomposite can be a product of sintering a homogeneous starting material mixture of Si and GaAs particles. The independent phase of the Si can correspond to the Si particles in the starting material mixture, and the independent phase of the GaAs can correspond to the GaAs particles in the homogeneous starting material mixture. During the sintering, the Si particles and the GaAs particles can remain substantially insoluble and immiscible with one another. The independent phase of the Si and the independent phase of the GaAs can be nanophases that independently have a largest dimension of 1 nm to 999 nm, or 50 nm to 400 nm, or 100 nm to 200 nm, or less than or equal to 999 nm and greater than or equal to 1 nm, 2, 4, 6, 8, 10, 15, 20, 25, 30, 40, 50, 60, 70, 80, 90, 100, 110, 120, 130, 140, 150, 160, 170, 180, 190, 200, 210, 220, 230, 240, 250, 260, 270, 280, 290, 300, 350, 400, 450, 500, 600, 700, 800, or 900 nm.

The Si in the nanocomposite can include agglomerates of Si crystallites. Each of the agglomerates can include a plurality of the Si crystallites. The Si crystallites have a smaller volume than the agglomerates of the Si crystallites. The Si crystallites can have a smaller volume than the Si particles in the starting material mixture.

The GaAs in the nanocomposite can include single crystals of GaAs that are substantially non-agglomerated. The single crystals of the GaAs can have a volume that corresponds to the size of GaAs particles in a homogeneous starting material mixture that is sintered to form the nanocomposite. The single crystals of the GaAs can have a volume that is about the same as the volume of the GaAs particles in the starting material mixture.

In various embodiments, the nanocomposite is substantially free of additives and is substantially all Si and GaAs (e.g., one or more additives can be 0 wt % to 0.0001 wt % of the nanocomposite). In other embodiments, the nanocomposite can include one or more additives. One or more additives can increase the strength or hardness of the nanocomposite, and/or can improve other properties of the nanocomposite. The one or more additives can be homogeneously distributed throughout the nanocomposite. The one or more additives can include a material with greater hardness than Si and with greater hardness than GaAs. The one or more additives can be any suitable additives, such as diamond particles, silicon carbide particles, silicon nitride particles, or a combination thereof. The one or more additives can independently have a largest dimension of 1 nm to 999 nm, or 50 nm to 400 nm, or 100 nm to 200 nm, or less than or equal to 999 nm and greater than or equal to 1 nm, 2, 4, 6, 8, 10, 15, 20, 25, 30, 40, 50, 60, 70, 80, 90, 100, 110, 120, 130, 140, 150, 160, 170, 180, 190, 200, 210, 220, 230, 240, 250, 260, 270, 280, 290, 300, 350, 400, 450, 500, 600, 700, 800, or 900 nm. The one or more additives can form any suitable proportion of the nanocomposite, such as 0.0001 wt % to 20 wt % of the nanocomposite, 0.0001 wt % to 5 wt % of the nanocomposite, or less than or equal to 20 wt % and greater than or equal to 0.0001 wt %, 0.001, 0.01, 0.1, 0.5, 1, 2, 3, 4, 5, 6, 8, 10, 12, 14, 16, or 18 wt %. The nanocomposite can have a hardness that is greater than the hardness of Si, greater than a hardness of GaAs, and greater than a hardness of the additive, with the hardness of the Si, GaAs, and the additive determined alone prior to mixing with one another and formation of the nanocomposite. In other embodiments, the nanocomposite can have a hardness that is greater than the hardness of Si, greater than a hardness of GaAs, and less than a hardness of the additive.

In various embodiments, the nanocomposite can have a hardness that is greater than the hardness of the Si, and that is greater than the hardness of the GaAs, with the hardness of the Si and the GaAs determined alone prior to mixing with one another and formation of the nanocomposite.

The nanocomposite can have any suitable transmission properties for electromagnetic radiation. The nanocomposite can be substantially opaque to visual light. The nanocomposite can be transparent to infrared light having any suitable wavelength, such as 1 microns to 20 microns, or less than or equal to 20 microns and greater than or equal to 1 micron, 1.2, 1.4, 1.6, 1.8, 2, 2.2, 2.4, 2.6, 2.8, 3, 3.2, 3.4, 3.6, 3.8, 4, 4.2, 4.4, 4.6, 4.5, 5, 5.2, 5.4, 5.6, 5.8, 6, 6.2, 6.4, 6.6, 6.8, 7, 7.2, 7.4, 7.6, 7.8, 8, 8.2, 8.4, 8.6, 8.8, 9, 9.2, 9.4, 9.6, 9.8, 10, 10.2, 10.4, 10.6, 10.8, 11, 11.2, 11.4, 11.6, 11.8, 12, 12.2, 12.4, 12.6, 12.8, 13, 13.5, 14, 14.5, 15, 15.5, 16, 16.5, 17, 17.5, 18, 18.5, 19, or 19.5 microns. The nanocomposite can be transparent to shortwave-infrared electromagnetic radiation, midwave-infrared electromagnetic radiation, longwave-infrared electromagnetic radiation, or a combination thereof. The nanocomposite can be transparent to shortwave-infrared electromagnetic radiation, midwave-infrared electromagnetic radiation, and longwave-infrared electromagnetic radiation. The nanocomposite can independently have a transmittance of 50% to 100% for shortwave-infrared electromagnetic radiation, midwave-infrared electromagnetic radiation, longwave-infrared electromagnetic radiation, or a combination thereof, such as a transmittance of 80% to 100%, or less than or equal to 100% and greater than or equal to 50%, 52, 54, 56, 58, 60, 62, 64, 66, 68, 70, 72, 74, 76, 78, 80, 81, 82, 83, 84, 85, 86, 87, 88, 89, 90, 91, 92, 93, 94, 95, 96, 97, 98, or 99%.

The nanocomposite can be transparent to shortwave-infrared electromagnetic radiation having a wavelength of 1 μm to 3 μm. For example, the nanocomposite can have a transmittance of 50% to 100% for shortwave-infrared electromagnetic radiation having a wavelength of 1 μm to 3 μm, such as a transmittance of 80% to 100%, or less than or equal to 100% and greater than or equal to 50%, 52, 54, 56, 58, 60, 62, 64, 66, 68, 70, 72, 74, 76, 78, 80, 81, 82, 83, 84, 85, 86, 87, 88, 89, 90, 91, 92, 93, 94, 95, 96, 97, 98, or 99%.

The nanocomposite can be transparent to midwave-infrared electromagnetic radiation having a wavelength of 3 μm to 5 μm. For example, the nanocomposite can have a transmittance of 50% to 100% for midwave-infrared electromagnetic radiation having a wavelength of 3 μm to 5 μm, such as a transmittance of 80% to 100%, or less than or equal to 100% and greater than or equal to 50%, 52, 54, 56, 58, 60, 62, 64, 66, 68, 70, 72, 74, 76, 78, 80, 81, 82, 83, 84, 85, 86, 87, 88, 89, 90, 91, 92, 93, 94, 95, 96, 97, 98, or 99%.

The nanocomposite can be transparent to longwave-infrared electromagnetic radiation having a wavelength of 5 μm to 20 μm. For example, the nanocomposite can have a transmittance of 50% to 100% for longwave-infrared electromagnetic radiation having a wavelength of 5 μm to 20 μm, such as a transmittance of 80% to 100%, or less than or equal to 100% and greater than or equal to 50%, 52, 54, 56, 58, 60, 62, 64, 66, 68, 70, 72, 74, 76, 78, 80, 81, 82, 83, 84, 85, 86, 87, 88, 89, 90, 91, 92, 93, 94, 95, 96, 97, 98, or 99%.

The nanocomposite can have a transmittance of 50% to 100%, or 80% to 100%, or less than or equal to 100% and greater than or equal to 50%, 52, 54, 56, 58, 60, 62, 64, 66, 68, 70, 72, 74, 76, 78, 80, 82, 84, 86, 88, 90, 91, 92, 93, 94, 95, 96, 97, 98, or 99% for infrared electromagnetic irradiation having a wavelength of 1 microns to 20 microns, or less than or equal to 20 microns and greater than or equal to 1 micron, 1.2, 1.4, 1.6, 1.8, 2, 2.2, 2.4, 2.6, 2.8, 3, 3.2, 3.4, 3.6, 3.8, 4, 4.2, 4.4, 4.6, 4.5, 5, 5.2, 5.4, 5.6, 5.8, 6, 6.2, 6.4, 6.6, 6.8, 7, 7.2, 7.4, 7.6, 7.8, 8, 8.2, 8.4, 8.6, 8.8, 9, 9.2, 9.4, 9.6, 9.8, 10, 10.2, 10.4, 10.6, 10.8, 11, 11.2, 11.4, 11.6, 11.8, 12, 12.2, 12.4, 12.6, 12.8, 13, 13.5, 14, 14.5, 15, 15.5, 16, 16.5, 17, 17.5, 18, 18.5, 19, or 19.5 microns.

The nanocomposite can have any suitable physical form. For example, the nanocomposite can have a planar profile, a curved profile, a domed profile, or a combination thereof.

Infrared Window.

Various aspects provide an infrared window (e.g., an optical window) including the nanocomposite including Si and GaAs. The infrared window can have any suitable physical form, such as a planar profile, a curved profile, a domed profile, or a combination thereof. The infrared window including the nanocomposite can be attached to other materials in any suitable way, such as via brazing, gluing (e.g., via adhesive or thermoplastic materials such as a thermoplastic polymer), clamping, fastening via fasteners, or a combination thereof.

Method of Using the Nanocomposite.

Various aspects provide a method of using embodiments of the nanocomposite including Si and GaAs. The nanocomposite can be used in any suitable way. In some embodiments, the nanocomposite is useful as an infrared-transparent material. The method can include transmitting and/or receiving infrared light through the nanocomposite. The infrared light can be shortwave-infrared electromagnetic radiation, midwave-infrared electromagnetic radiation, longwave-infrared electromagnetic radiation, or a combination thereof. The infrared light can be longwave-infrared electromagnetic radiation. The infrared light can be infrared light having any suitable wavelength, such as 1 microns to 20 microns, or less than or equal to 20 microns and greater than or equal to 1 micron, 1.2, 1.4, 1.6, 1.8, 2, 2.2, 2.4, 2.6, 2.8, 3, 3.2, 3.4, 3.6, 3.8, 4, 4.2, 4.4, 4.6, 4.5, 5, 5.2, 5.4, 5.6, 5.8, 6, 6.2, 6.4, 6.6, 6.8, 7, 7.2, 7.4, 7.6, 7.88, 8.2, 8.4, 8.6, 8.8, 9.2, 9.4, 9.6, 9.8, 10, 10.2, 10.4, 10.6, 10.8, 11, 11.2, 11.4, 11.6, 11.8, 12, 12.2, 12.4, 12.6, 12.8, 13, 13.5, 14, 14.5, 15, 15.5, 16, 16.5, 17, 17.5, 18, 18.5, 19, or 19.5 microns.

Method of Making the Nanocomposite.

Various embodiments provide a method of making the nanocomposite including Si and GaAs. For example, the method can include sintering a green body including a compressed homogeneous mixture including Si particles and GaAs particles to form the nanocomposite including Si and GaAs.

The Si particles and the GaAs particles can independently have any suitable purity such that the nanocomposite is formed. For example, the Si particles and the GaAs particles can independent have a purity of 99.99 wt % pure to about 99.99999 wt,% pure, or at least about 99.999 wt % pure, or equal to or greater than 99.99 wt %, 99.999, 99.9999, 99.99999, or 99.999999 wt %.

The method can include compressing a homogeneous mixture including Si particles and GaAs particles to form the green body. The green body can have a density of about 40% to about 80% of a theoretical maximum density of the homogeneous mixture of the Si particles and GaAs particles, or about 50% to about 60%, or less than or equal to about 80% and greater than or equal to about 40%, 42, 44, 46, 48, 50, 52, 54, 56, 58, 60, 62, 64, 66, 68, 70, 72, 74, 76, or 78%. For example, the theoretical density of a nanocomposite that is 80 mole % GaAs and 20 mole % Si is about 4.73 g/cm$^3$, and the green body density can be about 2.2 g/cm$^3$ to about 3 g/cm$^3$, or about 2.4 g/cm$^3$ to about 2.8 g/cm$^3$.

The Si particles and the GaAs particles can be nanoparticles. The Si particles and the GaAs particles can have about the same size and shape as the corresponding independent Si and GaAs phases in the nanocomposite. The Si particles and the GaAs particles can independently have a largest dimension of 1 nm to 999 nm, or 50 nm to 400 nm, or 100 nm to 200 nm, or less than or equal to 999 nm and greater than or equal to 1 nm, 2, 4, 6, 8, 10, 15, 20, 25, 30, 40, 50, 60, 70, 80, 90, 100, 110, 120, 130, 140, 150, 160, 170, 180, 190, 200, 210, 220, 230, 240, 250, 260, 270, 280, 290, 300, 350, 400, 450, 500, 600, 700, 800, or 900 nm.

The sintering can include maintaining a sintering temperature for a suitable time period such that the nanocomposite is formed. The sintering temperature can be 700° C. to 1150° C., 800° C. to 1100° C., 900° C. to 1050° C., or less than or equal to 1150° C. and greater than or equal to 700° C., 720, 740, 760, 780, 800, 820, 840, 860, 880, 900, 910, 920, 930, 940, 950, 960, 970, 980, 990, 1000, 1010, 1020, 1030, 1040, 1050, 1060, 1070, 1080, 1090, 1100, 1110, 1120, 1130, or 1140° C.

The method can include pulverizing and/or grinding Si and/or GaAs to form the Si particles and/or the GaAs particles. The pulverizing and/or grinding can be performed in any suitable way, such as using a grinder, a mortar and pestle, a ball mill, or a combination thereof.

The method can include forming the homogeneous mixture of the Si particles and the GaAs particles. The mixture can be formed in any suitable way that generates an intimately homogeneous solid mixture with an even distribution of components. The forming of the mixture can include vapor-depositing silicon on GaAs particles. Such vapor-deposition can form Si on the GaAs particles, such as complete or partial shells of the Si on the GaAs particles. The forming of the mixture can include grinding a mixture of Si particles and GaAs particles. The grinding can include ball milling, use of a mortar and pestle, or a combination thereof.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure includes specific embodiments and optional features, modification and variation of the concepts herein disclosed may be resorted to by those of ordinary skill in the art, and that such modifications and variations are considered to be within the scope of embodiments of the present disclosure.

EXEMPLARY EMBODIMENTS

The following exemplary embodiments are provided, the numbering of which is not to be construed as designating levels of importance:

Embodiment 1 provides a nanocomposite comprising:
silicon (Si); and
gallium arsenide (GaAs).

Embodiment 2 provides the nanocomposite of Embodiment 1, wherein the Si and GaAs together are 80 wt % to 100 wt % of the nanocomposite.

Embodiment 3 provides the nanocomposite of any one of Embodiments 1-2, wherein the Si and GaAs together are 95 wt % to 100 wt % of the nanocomposite.

Embodiment 4 provides the nanocomposite of any one of Embodiments 1-3, wherein the Si and GaAs together are 99.9 wt % to 100 wt % of the nanocomposite.

Embodiment 5 provides the nanocomposite of any one of Embodiments 1-4, wherein the Si and GaAs together are 99.999 wt % to 100 wt % of the nanocomposite.

Embodiment 6 provides the nanocomposite of any one of Embodiments 1-5, wherein the nanocomposite has a molar ratio of the Si to the GaAs of about 5:95 to about 95:5.

Embodiment 7 provides the nanocomposite of any one of Embodiments 1-6, wherein the nanocomposite has a molar ratio of the Si to the GaAs of about 1:9 to about 9:1.

Embodiment 8 provides the nanocomposite of any one of Embodiments 1-7, wherein the nanocomposite has a molar ratio of the Si to the GaAs of about 1:4 to about 4:1.

Embodiment 9 provides the nanocomposite of any one of Embodiments 1-8, wherein the Si and GaAs are homogeneously distributed throughout the nanocomposite.

Embodiment 10 provides the nanocomposite of any one of Embodiments 1-9, wherein the nanocomposite is less than 0.1 wt % water.

Embodiment 11 provides the nanocomposite of any one of Embodiments 1-10, wherein the nanocomposite is less than 0.0001 wt % water.

Embodiment 12 provides the nanocomposite of any one of Embodiments 1-11, wherein the nanocomposite is substantially free of phases of the Si and phases of the GaAs that are combined or indistinct from one another.

Embodiment 13 provides the nanocomposite of any one of Embodiments 1-12, wherein the nanocomposite is substantially free of Si-containing phases that comprise GaAs, and wherein the nanocomposite is substantially free of GaAs-containing phases that comprise Si.

Embodiment 14 provides the nanocomposite of any one of Embodiments 1-13, wherein the nanocomposite comprises independent phases of the Si and the GaAs that are distinct from one another.

Embodiment 15 provides the nanocomposite of Embodiment 14, wherein the nanocomposite is a product of sintering a homogeneous starting material mixture of Si and GaAs particles, wherein the independent phase of the Si corresponds to the Si particles in the starting material mixture, and wherein the independent phase of the GaAs corresponds to the GaAs particles in the homogeneous starting material mixture.

Embodiment 16 provides the nanocomposite of Embodiment 15, wherein during the sintering, the Si particles and the GaAs particles remain substantially insoluble and immiscible with one another.

Embodiment 17 provides the nanocomposite of any one of Embodiments 14-16, wherein the independent phase of the Si and the independent phase of the GaAs independently have a largest dimension of 1 nm to 999 nm.

Embodiment 18 provides the nanocomposite of any one of Embodiments 14-17, wherein the independent phase of the Si and the independent phase of the GaAs independently have a largest dimension of 50 nm to 400 nm.

Embodiment 19 provides the nanocomposite of any one of Embodiments 14-18, wherein the independent phase of the Si and the independent phase of the GaAs independently have a largest dimension of 100 nm to 200 nm.

Embodiment 20 provides the nanocomposite of any one of Embodiments 14-19, wherein the Si comprises agglomerates of Si crystallites, wherein the Si crystallites have a smaller volume than the agglomerates of the Si crystallites.

Embodiment 21 provides the nanocomposite of Embodiment 20, wherein the Si crystallites have a smaller volume than Si particles in a starting material mixture used to form the nanocomposite.

Embodiment 22 provides the nanocomposite of any one of Embodiments 14-21, wherein the GaAs comprises single crystals that are substantially non-agglomerated.

Embodiment 23 provides the nanocomposite of any one of Embodiments 14-22, wherein the GaAs comprises single crystals that have a volume approximately equal to the volume of GaAs particles used to form the nanocomposite.

Embodiment 24 provides the nanocomposite of any one of Embodiments 1-23, further comprising one or more additives.

Embodiment 25 provides the nanocomposite of Embodiment 24, wherein the one or more additives are homogeneously distributed throughout the nanocomposite.

Embodiment 26 provides the nanocomposite of any one of Embodiments 24-25, wherein the one or more additives comprise a material with greater hardness than Si or GaAs.

Embodiment 27 provides the nanocomposite of any one of Embodiments 24-26, wherein the one or more additives comprise diamond particles, silicon carbide particles, silicon nitride particles, or a combination thereof.

Embodiment 28 provides the nanocomposite of any one of Embodiments 24-27, wherein the one or more additives has a largest dimension of 1 nm to 999 nm.

Embodiment 29 provides the nanocomposite of any one of Embodiments 24-28, wherein the one or more additives has a largest dimension of 50 nm to 400 nm.

Embodiment 30 provides the nanocomposite of any one of Embodiments 24-29, wherein the one or more additives has a largest dimension of 100 nm to 200 nm.

Embodiment 31 provides the nanocomposite of any one of Embodiments 24-30, wherein the one or more additives are 0.0001 wt % to 20 wt % of the nanocomposite.

Embodiment 32 provides the nanocomposite of any one of Embodiments 24-31, wherein the one or more additives are 0.0001 wt % to 5 wt % of the nanocomposite.

Embodiment 33 provides the nanocomposite of any one of Embodiments 24-32, wherein the nanocomposite has a hardness that is greater than a hardness of Si, greater than a hardness of GaAs, and greater than a hardness of the additive.

Embodiment 34 provides the nanocomposite of any one of Embodiments 24-33, wherein the nanocomposite has a hardness that is greater than a hardness of Si, greater than a hardness of GaAs, and less than a hardness of the additive.

Embodiment 35 provides the nanocomposite of any one of Embodiments 1-34, wherein the nanocomposite has a hardness that is greater than a hardness of Si and that is greater than a hardness of GaAs.

Embodiment 36 provides the nanocomposite of any one of Embodiments 1-35, wherein the nanocomposite is opaque to visual light.

Embodiment 37 provides the nanocomposite of any one of Embodiments 1-36, wherein the nanocomposite is transparent to shortwave-infrared electromagnetic radiation, midwave-infrared electromagnetic radiation, and longwave-infrared electromagnetic radiation.

Embodiment 38 provides the nanocomposite of any one of Embodiments 1-37, wherein the nanocomposite has a transmittance of 50% to 100% for shortwave-infrared electromagnetic radiation, midwave-infrared electromagnetic radiation, and longwave-infrared electromagnetic radiation.

Embodiment 39 provides the nanocomposite of any one of Embodiments 1-38, wherein the nanocomposite has a transmittance of 80% to 100% for shortwave-infrared electromagnetic radiation, midwave-infrared electromagnetic radiation, and longwave-infrared electromagnetic radiation.

Embodiment 40 provides the nanocomposite of any one of Embodiments 1-39, wherein the nanocomposite is transparent to shortwave-infrared electromagnetic radiation having a wavelength of 1 μm to 3 μm.

Embodiment 41 provides the nanocomposite of any one of Embodiments 1-40, wherein the nanocomposite has a transmittance of 50% to 100% for shortwave-infrared electromagnetic radiation having a wavelength of 1 μm to 3 μm.

Embodiment 42 provides the nanocomposite of any one of Embodiments 1-41, wherein the nanocomposite is transparent to midwave-infrared electromagnetic radiation having a wavelength of 3 μm to 5 μm.

Embodiment 43 provides the nanocomposite of any one of Embodiments 1-42, wherein the nanocomposite has a transmittance of 50% to 100% w for midwave-infrared electromagnetic radiation having a wavelength of 3 μm to 5 μm.

Embodiment 44 provides the nanocomposite of any one of Embodiments 1-43, wherein the nanocomposite is transparent to longwave-infrared electromagnetic radiation having a wavelength of 5 μm to 20 μm.

Embodiment 45 provides the nanocomposite of any one of Embodiments 1-44, wherein the nanocomposite has a transmittance of 50% to 100% for longwave-infrared electromagnetic radiation having a wavelength of 5 μm to 20 μm.

Embodiment 46 provides the nanocomposite of any one of Embodiments 1-45, wherein the nanocomposite has a planar profile.

Embodiment 47 provides the nanocomposite of any one of Embodiments 1-46, wherein the nanocomposite has a curved profile.

Embodiment 48 provides the nanocomposite of any one of Embodiments 1-47, wherein the nanocomposite has the shape of a dome.

Embodiment 49 provides a nanocomposite comprising:

silicon (Si) that is at least about 99.99 wt % pure; and gallium arsenide (GaAs) that forms a homogeneous mixture with the Si, wherein the GaAs is at least about 99.99 wt % pure, and the nanocomposite has a molar ratio of the Si to the GaAs of about 1:9 to about 9:1 wherein the nanocomposite comprises independent phases of the Si and the GaAs that are distinct from one another, the nanocomposite is substantially free of phases of the Si and phases of the GaAs that are combined or indistinct from one another, the independent phase of the Si and the independent phase of the GaAs independently have a largest dimension of 50 nm to 400 nm, and, the nanocomposite has a hardness that is greater than a hardness of the Si alone and that is greater than a hardness of the GaAs alone.

Embodiment 50 provides an infrared window comprising the nanocomposite of any one of Embodiments 1-49.

Embodiment 51 provides a method of using the nanocomposite of any one of Embodiments 1-49, the method comprising:

transmitting and/or receiving infrared light through the nanocomposite.

Embodiment 52 provides the method of Embodiment 51, wherein the infrared light is shortwave-infrared electromagnetic radiation, midwave-infrared electromagnetic radiation, longwave-infrared electromagnetic radiation, or a combination thereof.

Embodiment 53 provides the method of any one of Embodiments 51-52, wherein the infrared light is longwave-infrared electromagnetic radiation.

Embodiment 54 provides a method of making the nanocomposite of any one of Embodiments 1-49, the method comprising:

sintering a green body comprising a compressed homogeneous mixture comprising Si particles and GaAs particles to form the nanocomposite of any one of Embodiments 1-49.

Embodiment 55 provides the method of Embodiment 54, wherein the Si particles and the GaAs particles are independently about 99.99 wt % pure to about 99.99999 wt % pure.

Embodiment 56 provides the method of any one of Embodiments 54-55, wherein the Si particles and the GaAs particles are at least about 99.999 wt % pure.

Embodiment 57 provides the method of any one of Embodiments 54-56, further comprising compressing a homogeneous mixture comprising Si particles and GaAs particles to form the green body.

Embodiment 58 provides the method of any one of Embodiments 54-57, wherein the green body has a density of about 40% to about 80% of a theoretical maximum density of the homogeneous mixture of the Si particles and GaAs particles.

Embodiment 59 provides the method of any one of Embodiments 54-58, wherein the green body has a density of about 50% to about 60% of a theoretical maximum density of the homogeneous mixture of the Si particles and GaAs particles.

Embodiment 60 provides the method of any one of Embodiments 54-59, wherein the Si particles and the GaAs particles independently have a largest dimension of 1 nm to 999 nm.

Embodiment 61 provides the method of any one of Embodiments 54-60, wherein the Si particles and the GaAs particles independently have a largest dimension of 50 nm to 400 nm.

Embodiment 62 provides the method of any one of Embodiments 54-61, wherein the Si particles and the GaAs particles independently have a largest dimension of 100 nm to 200 nm.

Embodiment 63 provides the method of any one of Embodiments 54-62, wherein the sintering comprises maintaining a sintering temperature of 700° C. to 1150° C.

Embodiment 64 provides the method of Embodiment 63, wherein the sintering temperature is 800° C. to 1100° C.

Embodiment 65 provides the method of any one of Embodiments 63-64, wherein the sintering temperature is 900° C. to 1050° C.

Embodiment 66 provides the method of any one of Embodiments 54-65, further comprising pulverizing and/or grinding Si and/or GaAs to form the Si particles and the GaAs particles.

Embodiment 67 provides the method of any one of Embodiments 54-66, further comprising forming the homogeneous mixture of the Si particles and the GaAs particles.

Embodiment 68 provides the method of Embodiment 67, wherein forming the homogeneous mixture of the Si particles and the GaAs particles comprises vapor-depositing silicon on GaAs particles.

Embodiment 69 provides the method of Embodiment 68, wherein the vapor-deposition forms a Si shell on a GaAs particle core.

Embodiment 70 provides the method of any one of Embodiments 67-69, wherein forming the homogeneous mixture of the Si particles and the GaAs particles comprises grinding a mixture of Si particles and GaAs particles.

Embodiment 71 provides the method of Embodiment 70, wherein the grinding comprises ball milling, use of a mortar and pestle, or a combination thereof.

Embodiment 72 provides the nanocomposite, infrared window, method of using the nanocomposite, or method of making the nanocomposite of any one or any combination of Embodiments 1-71 optionally configured such that all elements or options recited are available to use or select from.

What is claimed is:

1. A nanocomposite comprising:

silicon (Si); and gallium arsenide (GaAs);

wherein the nanocomposite has a molar ratio of the Si to the GaAs of about 5:95 to about 95:5.

2. The nanocomposite of claim 1, wherein the Si and GaAs together are 80 wt % to 100 wt % of the nanocomposite.

3. The nanocomposite of claim 1, wherein the Si and GaAs together are 99.999 wt % to 100 wt % of the nanocomposite.

4. The nanocomposite of claim 1, wherein the nanocomposite has a molar ratio of the Si to the GaAs of about 1:9 to about 9:1.

5. The nanocomposite of claim 1, wherein the Si and GaAs are homogeneously distributed throughout the nanocomposite.

6. The nanocomposite of claim 1, wherein the nanocomposite is substantially free of Si-containing phases that comprise GaAs, and wherein the nanocomposite is substantially free of GaAs-containing phases that comprise Si.

7. The nanocomposite of claim 1, wherein the nanocomposite comprises independent phases of the Si and the GaAs that are distinct from one another.

8. The nanocomposite of claim 7, wherein the independent phase of the Si and the independent phase of the GaAs independently have a largest dimension of 50 nm to 400 nm.

9. The nanocomposite of claim 7, wherein the Si comprises agglomerates of Si crystallites.

10. The nanocomposite of claim 7, wherein the GaAs comprises single crystals that are substantially non-agglomerated.

11. The nanocomposite of claim 7, wherein the nanocomposite is a product of sintering a homogeneous starting material mixture of Si and GaAs particles, wherein the independent phase of the Si corresponds to the Si particles in the starting material mixture, wherein the independent phase of the GaAs corresponds to the GaAs particles in the homogeneous starting material mixture, and wherein during the sintering the Si particles and the GaAs particles remain substantially insoluble and immiscible with one another.

12. The nanocomposite of claim 1, further comprising one or more additives, wherein the one or more additives are homogeneously distributed throughout the nanocomposite, wherein the one or more additives comprise a material with greater hardness than Si or GaAs, and wherein the one or more additives are 0.0001 wt % to 20 wt % of the nanocomposite.

13. The nanocomposite of claim 12, wherein the one or more additives comprise diamond particles, silicon carbide particles, silicon nitride particles, or a combination thereof.

14. The nanocomposite of claim 1, wherein the nanocomposite has a hardness that is greater than a hardness of Si and that is greater than a hardness of GaAs.

15. The nanocomposite of claim 1, wherein the nanocomposite has a transmittance of 50% to 100% for shortwave-infrared electromagnetic radiation, midwave-infrared electromagnetic radiation, and longwave-infrared electromagnetic radiation.

16. The nanocomposite of claim 1, wherein the nanocomposite has a transmittance of 50% to 100% for longwave-infrared electromagnetic radiation having a wavelength of 5 μm to 20 μm.

17. A nanocomposite comprising:

silicon (Si);

gallium arsenide (GaAs); and one or more additives, wherein the one or more additives are homogeneously distributed throughout the nanocomposite, the one or more additives comprise a material with greater hardness than Si or GaAs, and the one or more additives are 0.0001 wt % to 20 wt % of the nanocomposite.

18. The nanocomposite of claim 17, wherein the one or more additives comprise diamond particles, silicon carbide particles, silicon nitride particles, or a combination thereof.

19. A nanocomposite comprising:

silicon (Si) that is at least about 99.99 wt % pure; and gallium arsenide (GaAs) that forms a homogeneous mixture with the Si, wherein the GaAs is at least about 99.99 wt % pure, and the nanocomposite has a molar ratio of the Si to the GaAs of about 1:9 to about 9:1;

wherein the nanocomposite comprises independent phases of the Si and the GaAs that are distinct from one another, the nanocomposite is substantially free of phases of the Si and phases of the GaAs that are combined or indistinct from one another, and the independent phase of the Si and the independent phase of the GaAs independently have a largest dimension of 50 nm to 400 nm.

* * * * *